US005826656A

United States Patent [19]

McGuire et al.

[11] Patent Number: 5,826,656

[45] Date of Patent: Oct. 27, 1998

[54] METHOD FOR RECOVERING WATERFLOOD RESIDUAL OIL

[75] Inventors: Patrick L. McGuire, Eagle River; Joseph L. Anders, Anchorage, both of Ak.

[73] Assignee: Atlantic Richfield Company, Los Angeles, Calif.

[21] Appl. No.: 642,743

[22] Filed: May 3, 1996

[51] Int. Cl.[6] ..... E21B 43/25

[52] U.S. Cl. ..... 166/305.1

[58] Field of Search ..... 166/305.1, 306, 166/400

[56] References Cited

U.S. PATENT DOCUMENTS

| | | | |
|---|---|---|---|
| 4,205,723 | 6/1980 | Clauset, Jr. | 166/294 |
| 4,560,003 | 12/1985 | McMillen et al. | 166/305.1 |
| 4,834,179 | 5/1989 | Kokolis et al. | 166/268 |
| 5,083,610 | 1/1992 | Sheehy | 166/246 |
| 5,190,105 | 3/1993 | D'Souza | 166/303 |
| 5,193,617 | 3/1993 | D'Souza | 166/263 |
| 5,246,072 | 9/1993 | Frazier, Jr. et al. | 166/273 |
| 5,339,900 | 8/1994 | Clough | 166/274 |
| 5,339,904 | 8/1994 | Jennings, Jr. et al. | 166/303 |
| 5,363,915 | 11/1994 | Marquis et al. | 166/274 |
| 5,381,863 | 1/1995 | Wehner | 166/263 |

*Primary Examiner*—William P. Neuder
*Attorney, Agent, or Firm*—F. Lindsey Scott

[57] ABSTRACT

A method for recovering waterflood residual oil from a waterflooded oil-bearing subterranean formation penetrated from an earth surface by at least one well by injecting an oil miscible solvent into a waterflood residual oil-bearing lower portion of the oil-bearing subterranean formation through a well completed for injection of the oil miscible solvent into the lower portion of the oil-bearing formation; continuing the injection of the oil miscible solvent into the lower portion of the oil-bearing formation for a period of time equal to at least one week; recompleting the well for production of quantities of the oil miscible solvent and quantities of waterflood residual oil from an upper portion of the oil-bearing formation; and producing quantities of the oil miscible solvent and waterflood residual oil from the upper portion of the oil-bearing formation. The formation may have previously been both waterflooded and oil miscible solvent flooded. The solvent may be injected through a horizontal well and solvent and oil may be recovered through a plurality of wells completed to produce oil and solvent from the upper portion of the oil-bearing formation.

17 Claims, 5 Drawing Sheets

METHOD FOR RECOVERING WATERFLOOD RESIDUAL OIL

BACKGROUND OF THE INVENTION

This invention relates to the recovery of waterflood residual oil from zones of a waterflooded and oil miscible solvent flooded oil-bearing formation not adequately contacted during the water flooding or oil miscible flooding operations.

In the production of oil from subterranean formations the oil may be produced initially by allowing the oil to flow as a result of the oil-bearing formation's natural pressure to the surface through boreholes extending from the surface into the subterranean oil-bearing formation without the use of pumps or the like. After the formation pressure has dropped to a value less than that required to cause fluids to flow to the surface at a satisfactory rate, pumps, gas lifts and other devices are used to move fluids from the formation to the surface.

After the oil flow from the formation has become insufficient to justify continued production by the use of pumps to remove fluids from the formation directly, this phase of production, which is referred to as primary production, is stopped and enhanced oil recovery processes are used. Enhanced recovery of the oil can be achieved by a variety of techniques which will vary widely depending upon the particular formation of interest. Waterflooding is widely used. In waterflooding, water is injected as a wave of fluid into the oil-bearing formation and pushed from a water injection well toward an oil production well. Oil initially and subsequently oil and injected water are recovered from the production well. Additional quantities of oil can be recovered from many formations by waterflooding. In waterflooding, especially in thick, highly permeable formations with good vertical communication, the water tends to "slump" in the formation since it is heavier than oil. Where vertical communication is available in the oil-bearing formation the water will tend to sink toward the lower portion of the formation as it passes from the injection well toward the production well. Producing fluids from the upper portion of the production well can cause the water sweep to extend into the upper portions of the formation in the vicinity of the production well, but in areas of the formation away from the injection well or the production well, the water sweep may be less effective in the upper portions of the formation.

Oil miscible solvent flooding has also been used alone or in combination with waterflooding to recover added quantities of oil from formations. The oil miscible solvent typically comprises hydrocarbons containing from one to about five carbon atoms, carbon dioxide, nitrogen and mixtures thereof and is injected from an injection well across the depth of the oil-bearing formation to form an injection wave of oil miscible solvent passing through the oil-bearing formation toward a production well.

The oil miscible solvent may be single contact or multicontact miscible with the oil as well known to those skilled in the art. The oil miscible solvent is generally lighter than the water and the oil in the oil-bearing formation. As a result the oil miscible solvent tends to rise through oil-bearing formations with good vertical communication as it moves toward the production well. This tendency can be mitigated to some extent in the vicinity of the production well by producing the oil miscible solvent from lower portions of the production well.

The use of waterflooding and oil miscible solvent flooding in combination in either single treatment or alternating multiple treatments of the formation has been successful in the recovery of additional quantities of oil from oil-bearing formations which no longer produce sufficient quantities of oil to economically warrant the further production of oil from the formation by primary oil recovery.

Notwithstanding the effectiveness of such treatments, there are areas in the treated formations which are not reached by the miscible solvent in either of or the combination of these two processes. These areas can contain substantial quantities of oil and particularly waterflood residual oil which are not recovered.

Since there is a continuing demand for oil and since such formations have already been accessed by drilled and completed wells, a continuing effort has been directed to the development of methods for increasing the amount of oil recoverable from such formations through the existing wells.

SUMMARY OF THE INVENTION

According to the present invention additional quantities of waterflood residual oil are recovered from a waterflooded oil-bearing subterranean formation penetrated from an earth surface by at least one well by a method comprising:

a) injecting an oil miscible solvent into a waterflood residual oil-bearing lower portion of the oil-bearing subterranean formation through a well completed for injection of the oil miscible solvent into the lower portion of the oil-bearing formation;

b) continuing the injection of the oil miscible solvent into the lower portion of the oil-bearing formation for a period of time equal to at least one week;

c) recompleting the well for production of quantities of the oil miscible solvent and quantities of waterflood residual oil from an upper portion of the oil-bearing formation; and d) producing quantities of the oil miscible solvent and waterflood residual oil from the upper portion of the oil-bearing formation.

Additional oil may be recovered from oil-bearing formations which have been waterflooded by injecting water into the oil-bearing formation through at least one injection well, recovering quantities of oil and injected water from at least one production well, with the production and injection wells being spaced apart, and thereafter injecting an oil miscible solvent selected from the group consisting of hydrocarbons containing from 1 to about 5 carbon atoms, carbon dioxide, nitrogen and mixtures thereof into the oil-bearing formation through the at least one injection well and recovering quantities of oil and injected oil miscible solvent from the at least one production well by a method consisting essentially of:

a) injecting an oil miscible solvent into a lower portion of the oil-bearing formation around at least one production well completed for injection of oil miscible solvent through the production well into the lower portion of the oil-bearing formation around the production well;

b) continuing the injection of the oil miscible solvent into the lower portion of the oil-bearing formation for a period of time equal to at least one week;

c) recompleting the production well for the production of quantities of the oil miscible solvent and quantities of oil from an upper portion of the oil-bearing formation; and, d) producing quantities of the oil miscible solvent and quantities of the oil from the upper portion of the oil-bearing formation.

Water may also be injected into the lower portion of the oil-bearing formation following the period of oil miscible solvent injection.

DESCRIPTION OF THE PREFERRED EMBODIMENTS

In the discussion of the Figures the same numbers will be used throughout to refer to the same or similar components. Not all pipes, pumps, valves and the like necessary to achieve the desired flows have been shown.

Figure 1:
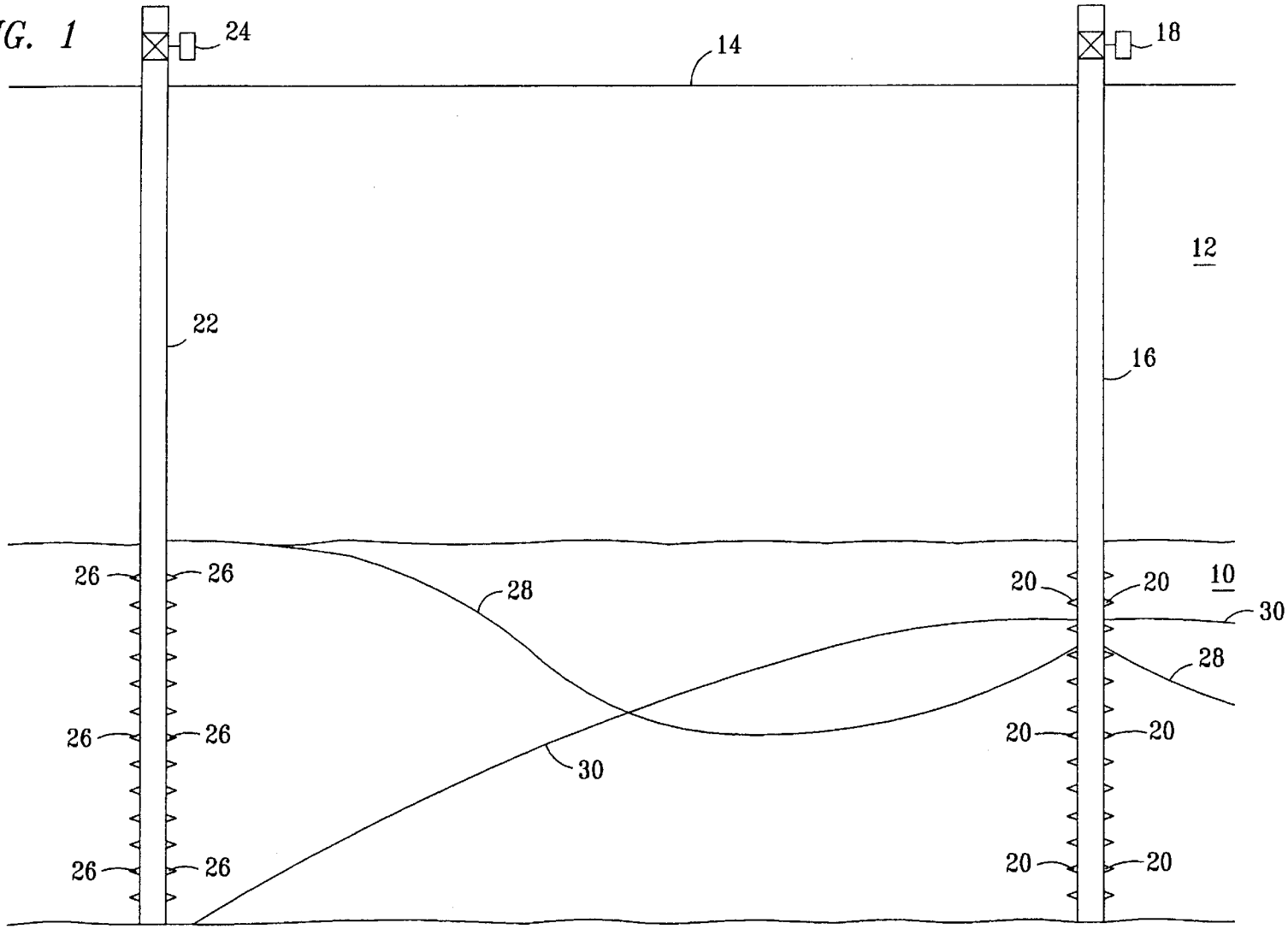
FIG. 1 is a schematic diagram of an oil-bearing formation penetrated by an injection well and a production well wherein the oil-bearing formation has been subjected to waterflooding and oil miscible solvent flooding.

In FIG. 1 an oil-bearing formation 10 is shown beneath an overburden 12 beneath an earth surface 14. Oil-bearing formation 10 is penetrated by a production well 16 which includes valves, piping and the like as known to those skilled in the art, shown schematically as a valve 18, for the production of fluids from production well 16. Production well 16 includes a plurality of perforations 20 which provide fluid communication between oil-bearing formation 10 and production well 16.

Oil-bearing formation 10 is also penetrated by an injection well 22 which includes piping, valves and the like as known to those skilled in the art, shown schematically as a valve 24, for the injection of fluids into injection well 22. Injection well 22 includes a plurality of perforations 26 which provide fluid communication between injection well 22 and oil-bearing formation 10.

As well known to those skilled in the art, production well 16 and injection well 22 normally comprise wellbores drilled from surface 14 into oil-bearing formation 10 and thereafter cased with the casing being cemented in place with perforations 20 and 26 extending through the casing and cement to provide fluid communication with the oil-bearing formation. Production and injection may be achieved through tubing (not shown) positioned in the wellbores as known to those skilled in the art.

The use of injection wells for the injection of fluids into oil-bearing formations occurs during the enhanced oil recovery phase of the life of the oil-bearing formation. During enhanced oil recovery fluids are frequently injected into oil-bearing formations to recover additional oil from such formations. In many instances a waterflood is used. During the waterflood, water is injected through injection well 22 into oil-bearing formation 10 through perforations 26 and moves through oil-bearing formation 10 toward production well 16 generally in an area beneath a line 28. This profile of the portion of the formation contacted by the water is very general and will vary from formation to formation. The water tends to sink or "slump" in oil-bearing formation 10 as it moves away from injection well 22. The water can be drawn upwardly into higher portions of oil-bearing formation 10 in the vicinity of production well 16 by selectively locating the perforations at a higher level. As well known to those skilled in the art, perforations can be used along the entire length of either injection well 22 or production well 16 and perforations can be selectively closed and opened at various points along the length of either well by techniques known to the art.

Alone, following or concurrent with the waterflood treatment, an oil miscible solvent flood may be used. The oil miscible solvent can vary widely. Generally the oil miscible solvent comprises hydrocarbons containing from 1 to about 5 carbon atoms, carbon dioxide, nitrogen and mixtures thereof. In some instances heavier hydrocarbons may be included in the oil miscible solvent. Such materials are considered to be included within the meaning of the term "oil miscible solvents" as used herein. The oil miscible solvent is generally injected along the entire length of injection well 22 in oil-bearing formation 10. As the oil miscible solvent moves toward production well 16 it tends to rise in oil-bearing formation 10 as a result of the presence of water in the formation and the fact that the specific gravity of the oil miscible solvent is generally less than that of both water and the oil in oil-bearing formation 10. The area generally contacted by the oil miscible solvent is shown in FIG. 1 as that area above a line 30. Generally the oil miscible solvent and quantities of oil released by contact with the oil miscible solvent are recovered through those perforations in the upper portion of oil-bearing formation 10 as shown. While production of these fluids from a point lower in production well 16 may result in drawing oil and oil miscible solvent to slightly lower levels in oil-bearing formation 10 in the vicinity of production well 16, it becomes increasingly difficult to recover the fluids without the presence of substantial quantities of water as the recovery level is lowered.

The operation of waterfloods and oil miscible solvent floods is well known to those skilled in the art either as single treatments of oil-bearing formations or as alternative repeating treatments frequently referred to as water-alternating-gas treatments. In either event substantial quantities of oil-bearing formation 10 may remain uncontacted by the oil miscible solvent. These areas are generally in the vicinity of the bottom of production well 16.

Figure 2:
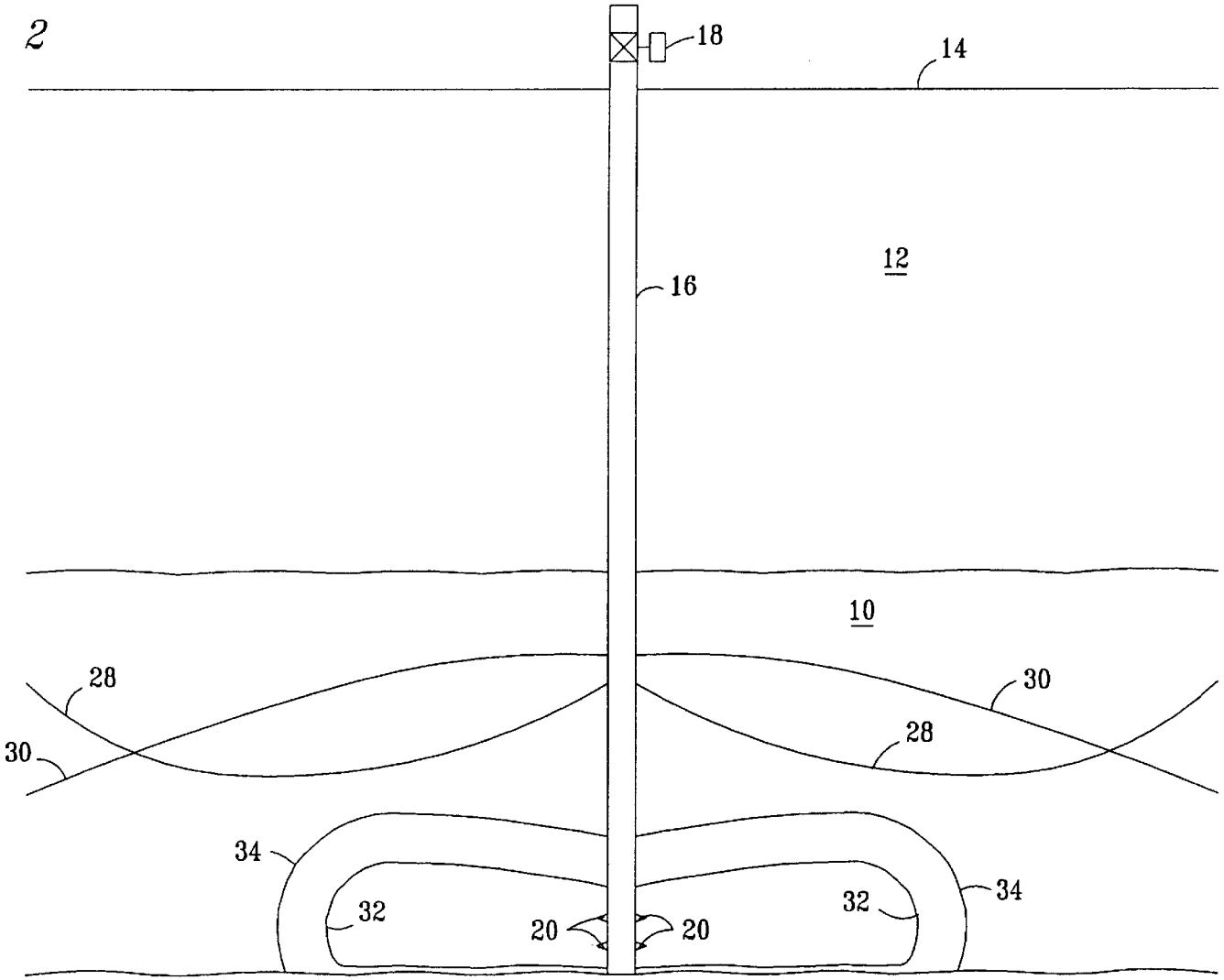
FIG. 2 is a schematic diagram of an oil-bearing formation which has been waterflooded and oil solvent flooded showing the positioning of an oil miscible solvent injected according to the present invention.

In FIG. 2 an embodiment of the present invention is shown. In FIG. 2 oil miscible solvent is injected into oil-bearing formation 10 through the bottom of the existing production well 16. Production well 16 is recompleted to move the points of fluid communication with oil-bearing formation 10 to the lower part of production well 16 as shown by perforations 20. Oil miscible solvent is injected through production well 16 into oil-bearing formation 10 for a period of time from about one week to about one year to contact waterflood residual oil in the areas of oil-bearing formation 10 around the bottom of production well 16. The solvent can be injected at a wide variety of rates in substantially varying quantities. Generally the quantity and rate will be determined by the conditions such as pressure, permeability and the like in the formation. The quantity of solvent injected will vary depending upon the volume of oil-bearing formation 10 which can be effectively contacted with the oil miscible solvent by such injection. As shown in FIG. 2 the injected oil miscible solvent occupies an area enclosed generally by a line 32. This area will vary widely as to its configuration and its uniformity dependent upon the properties of the formation treated. The solvent in any event contacts an area extending radially outwardly around the bottom of production well 16. Quantities of waterflood residual oil are released and moved outwardly and upwardly in oil-bearing formation 10 as shown generally by the area between line 32 and a line 34. This oil is oil which has been released by the oil miscible solvent which has contacted the oil-bearing formation in areas previously subjected only to a waterflood. In some formations it may be desirable to inject water following the oil miscible solvent to move the oil miscible solvent further into the formative and upwardly in the formation. The water injection may be done through perforations 20 as shown in FIG. 2.

Figure 3:
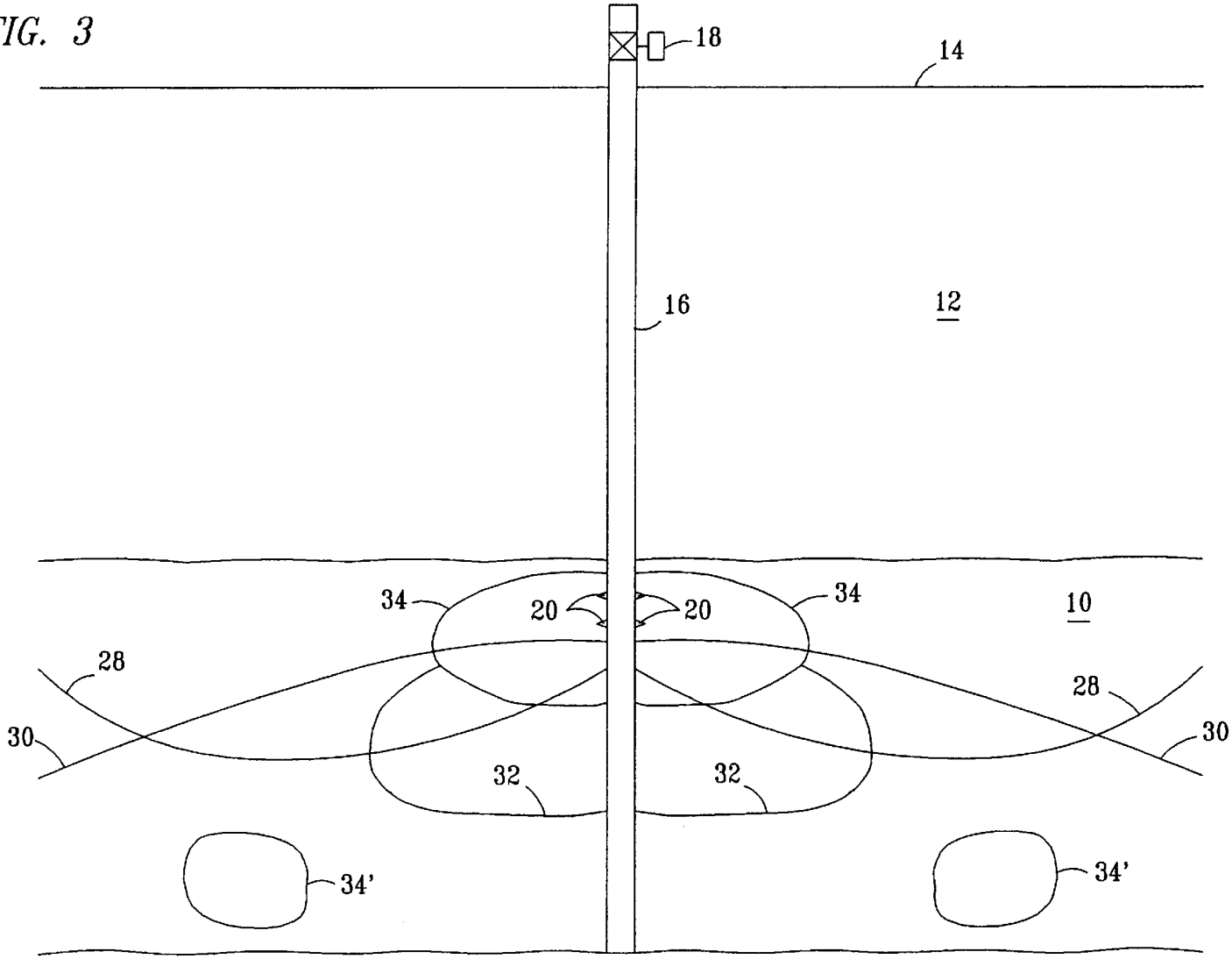
FIG. 3 is a schematic diagram of an oil-bearing formation which has been waterflooded and oil miscible solvent flooded showing the positioning of a quantity of solvent injected according to the present invention after the initiation of production of residual waterflood oil and oil miscible solvent through the production well according to the present invention.

In FIG. 3 oil-bearing formation 10 is shown after completion of the oil miscible solvent injection, recompletion of production well 16 to produce fluids from oil-bearing formation 10 through perforations 20 in the upper portion of oil-bearing formation 10 and initiation of fluid production through perforations 20. The oil has been drawn upwardly along with the oil miscible solvent so that oil and mixtures of oil and oil miscible solvent are recovered through perforations 20. The general positions of the oil and solvent are shown by the area enclosed by lines 32 and by the area enclosed by lines 34. Quantities of oil shown in the areas enclosed by the lines 34' will remain in oil-bearing formation 10 in some of the volume that was contacted by the oil miscible solvent but subsequently reinvaded by the displaced oil as the oil miscible solvent was drawn upward by production through perforations 20 at the top of the well. This oil may not be recoverable by economic means but additional quantities of oil are recovered by the action of the oil miscible solvent in the area surrounding production well 16 as shown.

Figure 4:
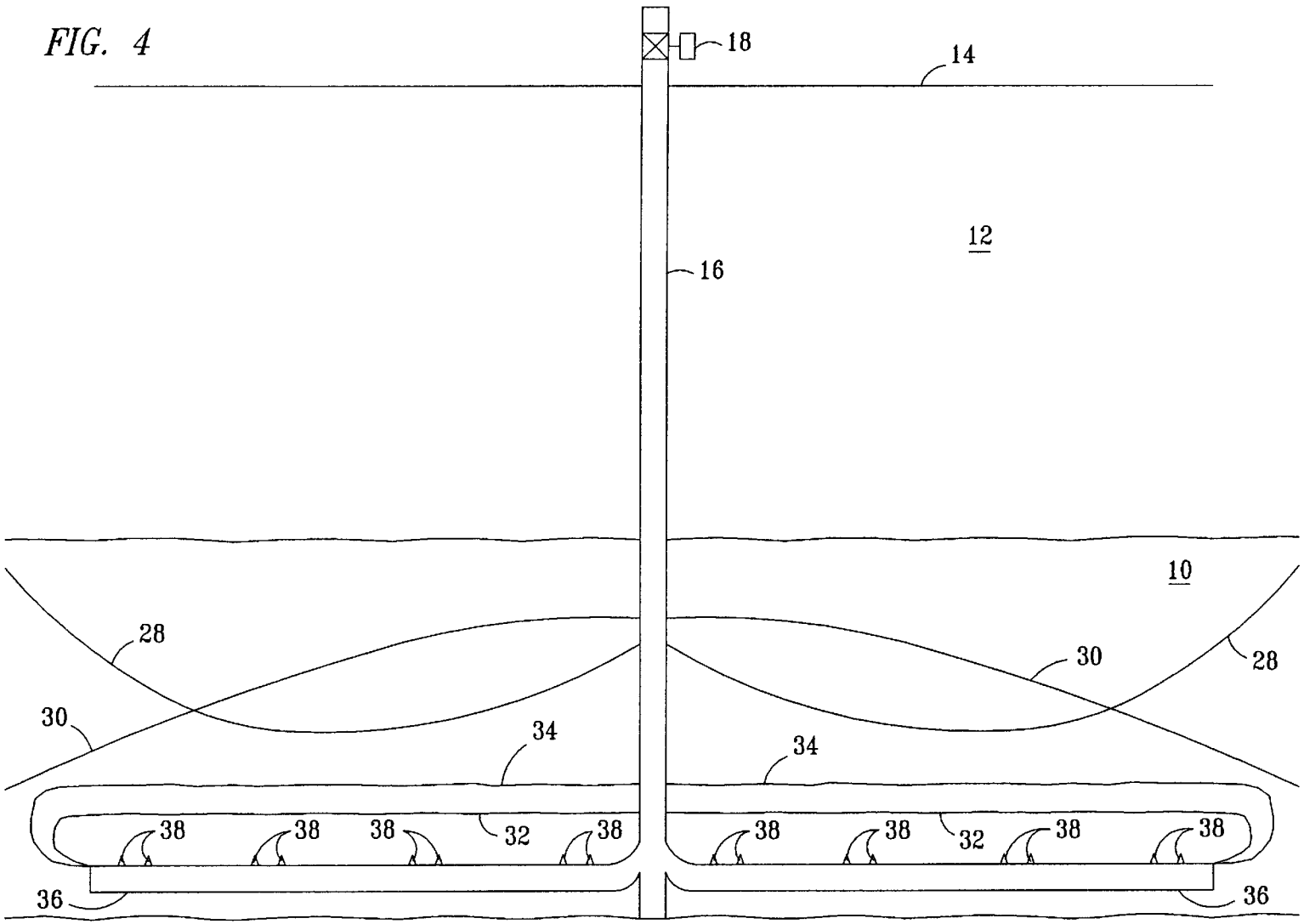
FIG. 4 is a schematic diagram of an embodiment of the present invention wherein the oil miscible solvent is injected through a production well and horizontal wells extending from the bottom of the production well.

In FIG. 4 a further variation of the method of the present invention is shown. In this embodiment the oil miscible solvent is injected into oil-bearing formation 10 through horizontal wells 36 which extend from the bottom portion of production well 16. Such wells are readily drilled by techniques well known to those skilled in the art. The communication between production well 16 and oil-bearing formation 10 is via horizontal wells 36 which are perforated by a plurality of perforations 38. As shown the oil miscible solvent is injected over a wider radial area and liberates oil from areas of the formation previously contacted only by the waterflood. Perforations 38 are spaced to inject oil miscible solvent into formation 10 in selected areas to optimize oil recovery from formation 10. Water injection into formation 10 following the solvent injection may be through horizontal wells 36 or existing injection wells in the area or both.

The solvent is injected in an area generally shown by lines 32 with the released oil being shown by lines 34. The oil and solvent are recovered as previously discussed by closing horizontal wells 36 and recompleting production well 16 either by perforations into oil-bearing formation 10 or by the use of horizontal wells drilled in the upper portion of oil-bearing formation 10 from production well 16. Generally it will be most effective economically to recover the injected solvent and oil through perforations from production well 16 into the upper portion of oil-bearing formation 10. In such instances solvent is drawn upwardly with oil through a large area previously contacted only by the waterflood.

In the practice of the method of the present invention the existing wells in the formation are used. The production wells are readily recompleted to achieve injection or production into or from the desired portion of oil-bearing formation 10 by means well known to those skilled in the art. For instance the perforations and horizontal wellbores can readily be closed by cementing and subsequently redrilled or reperforated as desired to reestablish communication in the areas previously closed. Perforations can be opened by reperforating and the horizontal wells can be recompleted by drilling out the cement, reperforating and the like. These techniques and others are well known to those skilled in the art for the recompletion of wells and will not be discussed further.

When horizontal wells are used for the injection of the oil miscible solvent production of miscible solvent and additional oil may be achieved not only from production well 16 but from surrounding production wells which may or may not have been similarly treated by oil miscible solvent injection. In many oil fields well spacings are used which results in wells being positioned so that when injection is accomplished through one production well, especially when horizontal injection wells are used, solvent and oil may also be produced from surrounding production wells which have been completed to recover oil and solvent from the upper portion of formation 10. Such variations and benefits are within the scope of the present invention and may be realized by the practice of the method of the present invention. Specifically the recovery of additional oil from production wells other than the production well through which injection is accomplished may be achieved.

Figure 5:
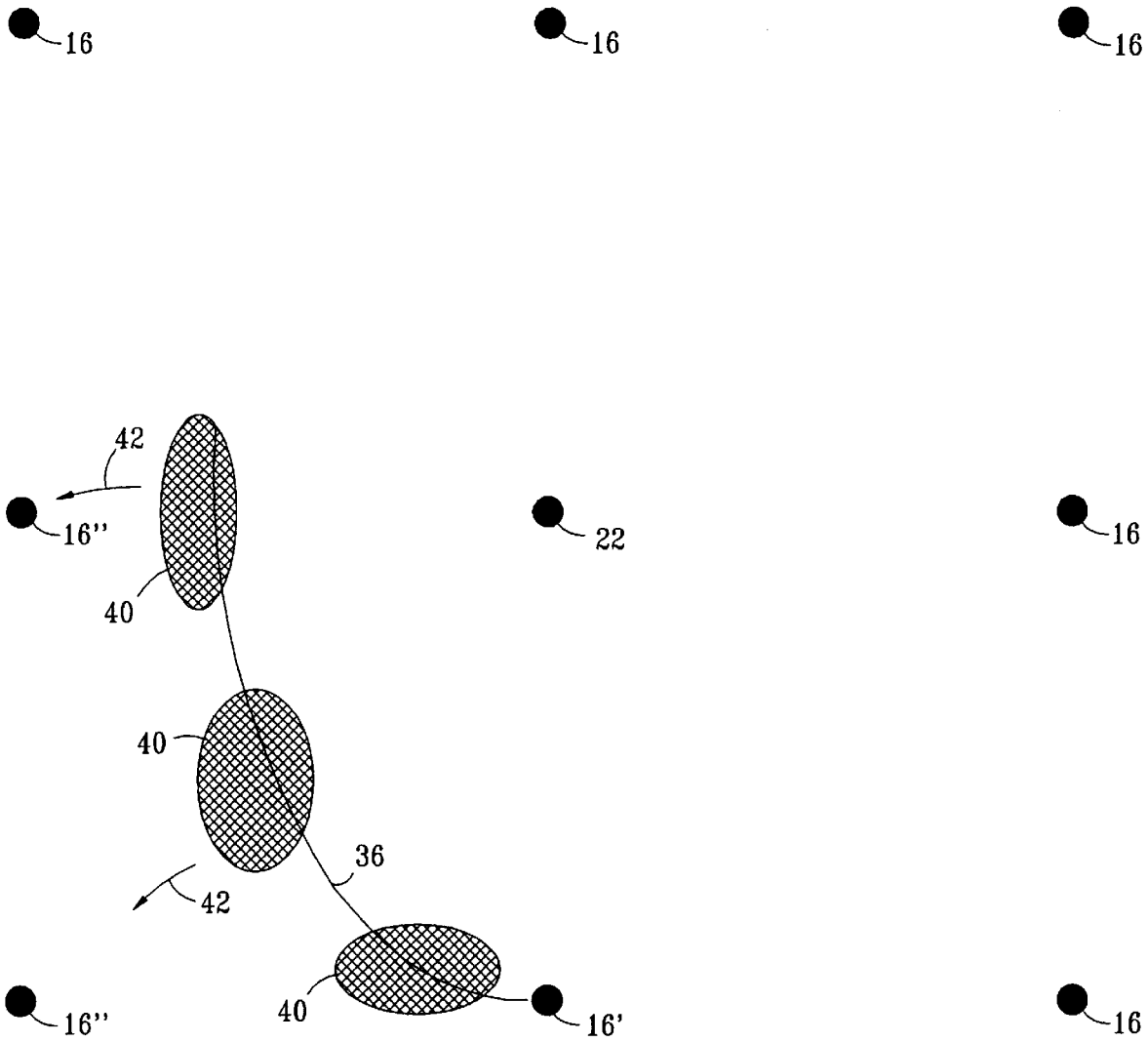
FIG. 5 is a topographical diagram of an embodiment of the present invention wherein the oil miscible solvent is injected through a production well and a horizontal well extending from the production well with oil and injected solvent being recovered from a plurality of production wells.

In FIG. 5 a topographical diagram of a nine-spot well pattern is shown. The pattern basically comprises eight production wells positioned evenly along the sides and at the corners of a quadrangle which has an injection well at its center. Horizontal well 36 is shown extending from production well 16'. Oil miscible solvent is injected into formation 10 via production well 16' and horizontal well 36 into solvent treated areas shown as zones 40. The solvent treated areas are located so that oil and solvent flow to production wells 16" and 16' when the solvent injection, and any optional water injection, has been completed and production of fluids from the upper portion of the formation via the production wells has been commenced. Further solvent, water or both may be injected from injection well 22 in conjunction with production from the production wells to increase oil production from the formation. Further additional horizontal wells may be extended from well 16' or another of the production wells to inject solvent into untreated areas of the nine-spot pattern to recover additional oil through additional production wells.

Oil-bearing formation 10 is desirably a relatively thick formation with a relatively high permeability which is adapted to waterflooding and oil miscible solvent flooding. Desirably the formation also has relatively good vertical communication. The vertical communication contributes to the movement of water to the lower portions of oil-bearing formation 10, the movement of the oil miscible solvent to the upper portions of oil-bearing formation 10 and the ability of the injected solvent to move upwardly around production well 16 according to the method of the present invention.

The method of the present invention is different than conventional huff and puff recovery processes wherein fluid is injected into a formation through perforations or the like from the well into the formation with the injected fluid and oil thereafter being recovered through the same perforations used for injection. The present invention uses a production well which is recompleted (or a new well) for injection of oil miscible solvent into the lower portion of the formation. After the injection is complete the production well is recompleted to recover fluids from an upper portion of the formation. This results in drawing the solvent into and through uncontacted areas of the formation which are not effectively contacted by a huff and puff process and minimizes oil reinvading the volume contacted by the oil miscible solvent.

By the method of the present invention oil is recovered from oil-bearing formation 10 in areas not previously contacted by the oil miscible solvent flood. This oil is recovered using existing wells at relatively low cost. As noted this oil can be recovered using existing wells or additional wells can be completed or recompleted as required.

Having thus described the invention by reference to its preferred embodiments it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

What is claimed is:

1. A method for recovering waterflood residual oil from a waterflooded oil-bearing subterranean formation penetrated from an earth surface by at least one production well used for production of oil and water during the waterflood the method comprising:

a. injecting an oil miscible solvent into a waterflood residual oil-bearing lower portion of the oil-bearing subterranean formation through the production well completed for injection of the oil miscible solvent into the lower portion of the oil-bearing formation;

b. continuing the injection of the oil miscible solvent into the lower portion of the oil-bearing formation for a period of time equal to at least one week;

c. recompleting the production well for production of quantities of the oil miscible solvent and quantities of waterflood residual oil from an upper portion of the oil-bearing formation; and d. producing quantities of the oil miscible solvent and the waterflood residual oil from the upper portion of the oil-bearing formation through the recompleted production well.

2. The method of claim 1 wherein the oil miscible solvent is selected from the group consisting of hydrocarbons containing from 1 to about 5 carbon atoms, carbon dioxide, nitrogen and mixtures thereof.

3. The method of claim 1 wherein the oil-bearing formation has also been oil miscible solvent flooded.

4. The method of claim 3 wherein the oil miscible solvent is selected from the group consisting of hydrocarbons containing from 1 to about 5 carbon atoms, carbon dioxide, nitrogen and mixtures thereof.

5. The method of claim 1 wherein the period of time is from about one week to about one year.

6. The method of claim 1 wherein the well is completed to include at least one horizontal well in the lower portion of the oil-bearing formation and in fluid communication with the well for injection of the oil miscible solvent into the lower portion of the oil-bearing formation.

7. The method of claim 6 wherein the well is recompleted to include at least one horizontal well in the upper portion of the oil-bearing formation and in fluid communication with the well for producing quantities of the oil miscible solvent and quantities of oil.

8. The method of claim 6 wherein quantities of oil miscible solvent and waterflood residual oil are recovered from the upper portion of the oil-bearing formation through a plurality of wells completed for the production of oil miscible solvent and waterflood residual oil from the upper portion of the formation.

9. A method for recovering additional oil from an oil-bearing formation which has been waterflooded by injecting water into the oil-bearing formation through at least one injection well, recovering quantities of oil and injected water from a production well, the production and injection wells being spaced apart and oil miscible solvent treated by injecting an oil miscible solvent selected from the group consisting of hydrocarbons containing from 1 to about 5 carbon atoms, carbon dioxide, nitrogen and mixtures thereof into the oil-bearing formation through at least one injection well and recovering quantities of oil and injected oil miscible solvent from the production well, the method consisting essentially of:

a. injecting an oil miscible solvent into a lower portion of the oil-bearing formation through the production well completed for injection of oil miscible solvent through the production well into the lower portion of the oil-bearing formation around the production well;

b. continuing the injection of the oil miscible solvent into the lower portion of the oil-bearing formation for a period of time equal to at least one week;

c. recompleting the production well for the production of quantities of the oil miscible solvent and quantities of oil from an upper portion of the oil-bearing formation; and, d. producing quantities of the oil miscible solvent and quantities of the oil from the upper portion of the oil-bearing formation.

10. The method of claim 9 wherein the period of time is from about one week to about one year.

11. The method of claim 10 wherein the production well is completed to include at least one horizontal well in the lower portion of the oil-bearing formation and in fuid communication with the well for injection of the oil miscible solvent into the lower portion of the oil-bearing formation.

12. The method of claim 11 wherein the production well is recompleted to include at least one horizontal well in the upper portion of the oil-bearing formation and in fluid communication with the well for producing quantities of the oil miscible solvent and quantities of oil.

13. The method of claim 11 wherein quantities of oil miscible solvent and waterflood residual oil are recovered from the upper portion of the oil-bearing formation through a plurality of wells completed for the production of oil miscible solvent and waterflood residual oil from the upper portion of the formation.

14. The method of claim 9 wherein a plurality of production wells are used.

15. A method for recovering waterflood residual oil from a waterflooded and oil-miscible solvent flooded oil-bearing subterranean formation penetrated from an earth surface by at least one production well used for production of oil and water during the waterflood and oil and oil-miscible solvent during the oil-miscible solvent flood, the method comprising:

a. injecting an oil miscible solvent into a waterflood residual oil-bearing lower portion of the oil-bearing subterranean formation through the production well completed for injection of the oil miscible solvent into the lower portion of the oil-bearing formation;

b. continuing the injection of the oil miscible solvent into the lower portion of the oil-bearing formation for a period of time equal to at least one week;

c. recompleting the production well for production of quantities of the oil miscible solvent and quantities of waterflood residual oil from an upper portion of the oil-bearing formation; and d. producing quantities of the oil miscible solvent and the waterflood residual oil from the upper portion of the oil-bearing formation through the recompleted production well.

16. The method of claim 15 wherein the oil miscible solvent is selected from the group consisting of hydrocarbons containing from 1 to about 5 carbon atoms, carbon dioxide, nitrogen and mixtures thereof.

17. The method of claim 15 wherein the oil miscible solvent is selected from the group consisting of hydrocarbons containing from 1 to about 5 carbon atoms, carbon dioxide, nitrogen and mixtures thereof.

* * * * *